US011832727B2

(12) United States Patent
Murphy

(10) Patent No.: US 11,832,727 B2
(45) Date of Patent: Dec. 5, 2023

(54) RECLINING SEATING UNIT WITH WALL-PROXIMITY CAPABILITY AND EXTENDABLE HEADREST

(71) Applicant: Ultra-Mek, Inc., Denton, NC (US)

(72) Inventor: Marcus L. Murphy, Lexington, NC (US)

(73) Assignee: ULTRA-MEK, INC., Denton, NC (US)

( * ) Notice: Subject to any disclaimer, the term of this patent is extended or adjusted under 35 U.S.C. 154(b) by 0 days.

(21) Appl. No.: 17/828,732

(22) Filed: May 31, 2022

(65) Prior Publication Data

US 2023/0010099 A1 Jan. 12, 2023

Related U.S. Application Data

(60) Provisional application No. 63/219,495, filed on Jul. 8, 2021.

(51) Int. Cl.

| | |
|---|---|
| ***A47C 1/02*** | (2006.01) |
| ***A47C 7/60*** | (2006.01) |
| ***A47C 7/56*** | (2006.01) |
| ***A47C 1/0355*** | (2013.01) |

(52) U.S. Cl.

CPC ..... *A47C 1/0355* (2013.01)

(58) Field of Classification Search

CPC ..... A47C 1/03211; A47C 7/506; A47C 1/022; A47C 1/037; A47C 7/5068; A47C 1/03272; A47C 1/034; A47C 1/0342; A47C 3/027; A47C 7/52; A47C 1/03294; A47C 1/0345; A47C 1/0347; A47C 1/0352; A47C 12/02; A47C 16/025; A47C 7/503; A47C 1/0355

See application file for complete search history.

(56) References Cited

U.S. PATENT DOCUMENTS 2,948,331 A * 8/1960 Schliephacke ..... A47C 1/0355 297/86

3,009,734 A * 11/1961 Schliephacke ..... A47C 1/0355 297/84

(Continued)

*Primary Examiner* — Shin H Kim

(74) *Attorney, Agent, or Firm* — Myers Bigel, P.A.

(57) ABSTRACT

A wall-proximity reclining seating unit includes: a frame having a back member and a pair of arms, the back member being fixed relative to and extending between the arms; a backrest; a seat; a footrest; a reclining mechanism connected between the frame, backrest, seat, and footrest comprising a series of pivotally interconnected links that move the seating unit between: (a) an upright position, in which the footrest is retracted below a forward portion of the seat and faces generally downwardly and defines an angle of between about 20 and 40 degrees with the underlying surface, (b) a TV position, in which the footrest is extended in front of the seat and is generally horizontally disposed, and the seat and backrest are moved forwardly relative to the frame between about 2.5 and 4 inches; and (c) a fully reclined position, in which the backrest is disposed at an angle shallower than the first backrest angle, the footrest remains extended in front of the seat, and the seat is moved forward of its position in the TV position between about 4 and 7 inches. A power actuator coupled to the reclining mechanism drives the backrest, seat and footrest between the upright, TV and fully reclined positions.

14 Claims, 7 Drawing Sheets

(56) References Cited

U.S. PATENT DOCUMENTS

| | | | | | |
|---|---|---|---|---|---|
| 4,077,663 | A * | 3/1978 | Cycowicz | A47C 1/0352 | 297/322 |
| 4,337,977 | A * | 7/1982 | Rogers, Jr. | A47C 1/0355 | 297/85 L |
| 4,531,778 | A * | 7/1985 | Rogers, Jr. | A47C 1/0352 | 297/85 L |
| 4,805,960 | A * | 2/1989 | Tacker | A47C 1/0355 | 297/86 |
| 5,588,710 | A * | 12/1996 | Wiecek | A47C 1/0355 | 297/85 L |
| 5,992,930 | A * | 11/1999 | LaPointe | A47C 1/0352 | 297/83 |
| 7,731,276 | B2 * | 6/2010 | Hoffman | A47C 1/0355 | 297/259.2 |
| 9,603,453 | B2 * | 3/2017 | Hoffman | A47C 1/03211 | |
| 10,524,575 | B2 * | 1/2020 | LaPointe | A47C 3/027 | |
| 11,197,549 | B1 * | 12/2021 | LaPointe | A47C 1/0347 | |
| 2008/0036248 | A1 * | 2/2008 | Beaver | A47C 1/0355 | 297/329 |
| 2011/0248530 | A1 * | 10/2011 | Sartisohn | A47C 1/034 | 297/83 |
| 2012/0286557 | A1 * | 11/2012 | Hoffman | A47C 1/03211 | 297/85 M |
| 2020/0163458 | A1 * | 5/2020 | Murphy | A47C 1/0355 | |

* cited by examiner

RECLINING SEATING UNIT WITH WALL-PROXIMITY CAPABILITY AND EXTENDABLE HEADREST

RELATED APPLICATION

The present application claims priority from and the benefit of U.S. Provisional Patent Application No. 63/219,495, filed Jul. 8, 2021, the disclosure of which is hereby incorporated herein by reference in its entirety.

FIELD OF THE INVENTION

The present invention relates generally to seating units, and relates more particularly to reclining seating units.

BACKGROUND OF THE INVENTION

Recliner chairs and other reclining seating units have proven to be popular with consumers. These seating units typically move from an upright position, in which the backrest is generally upright, to one or more reclined positions, in Which the backrest pivots to be less upright. The movement of the seating unit between the upright and reclined positions is typically controlled by a pair of matching reclining mechanisms that are attached to the seat, backrest and base of the chair.

One particularly popular reclining chair is the so-called "wall-proximity" chair. In a conventional reclining chair, as the backrest moves to the reclined position, the upper end of the backrest moves rear artily relative to the base of the chair. As a result, typically the chair cannot be positioned such that the backrest is adjacent a wall, as the reclining backrest would strike the wall and thereby be prevented from fully reclining. A "wall-proximity" reclining chair includes some type of mechanism (typically either a linkage or a set of wheels that roll on a track) that move the seat of the chair forward relative to the base to provide additional room for the backrest to recline. Typically, such chairs are configured so that the seat and backrest move forward relative to the base when the chair moves from an upright position to a partially reclined "TV" position, in which the footrest is extended. The seat and backrest then move farther forward relative to the base as the chair from the TV position to its fully reclined position. Exemplary wall-proximity chairs are illustrated in U.S. Pat. No. 4,077,663 to Cycowicz et al., U.S. Pat. No. 4,337,977 to Rogers et al., U.S. Pat. No. 4,531,778 to Rogers, U.S. Pat. No. 4,805,960 to Tacker, U.S. Pat. No. 5,588,710 to Wiecek, and U.S. Pat. No. 5,992,930 to LaPointe et al., and in U.S. Patent Publication No. 2008/0036248 to Murphy et al., the disclosures of each of which are hereby incorporated herein in their entireties. A typical wall-proximity chair in its upright position can be placed with the backrest within 3 to 4 inches of an adjacent wall and still avoid striking the adjacent wall when moved to the fully reclined position.

One potential shortcoming of wall-proximity chairs is that the wall-proximity mechanism or wheel/rail system is typically somewhat complex, with multiple interconnected intricate parts. As such, production of these mechanisms can be relatively expensive. Also, the mechanisms that control the movement of wall-proximity chairs tend to be rather bulky, and therefore may be unsuitable for some specialized chairs. For example, some chairs have a "high leg" style in which the arms of the chair are raised several inches off of the underlying surface (typically between about 4 and 9 inches). It is ordinarily undesirable for portions of a reclining mechanism to be visible in the space below the chair when the chair is in the upright position, so the designers are faced with providing a reclining mechanism that folds into a relatively small package that is not visible from the side in the upright position.

SUMMARY

As a first aspect, embodiments of the invention are directed to a wall-proximity reclining seating unit. The seating unit comprises: a frame having a back member and a pair of arms, the back member being fixed relative to and extending between the arms; a backrest; a seat; a footrest; a reclining mechanism connected between the frame, backrest, seat, and footrest, the reclining mechanism comprising a series of pivotally interconnected links and configured to move the seating unit between: (a) an upright position, in which the backrest is disposed at a first generally upright backrest angle, the seat is disposed at a first generally horizontal seat angle, and the footrest is retracted below a forward portion of the seat and faces generally downwardly and defines an angle of between about 20 and 40 degrees with the underlying surface, (b) a TV position, in which the backrest substantially maintains the first backrest angle, the seat is disposed at a second seat angle that is steeper than the first seat angle, the footrest is extended in front of the seat and is generally horizontally disposed, and the seat and backrest are moved forwardly relative to the frame between about 2.5 and 4 inches; and (c) a fully reclined position, in which the backrest is disposed at a second backrest angle that is shallower than the first backrest angle, the footrest remains extended in front of the seat, and the seat is moved forward of its position in the TV position between about 4 and 7 inches; and a power actuator coupled to the reclining mechanism that drives the backrest, seat and footrest between the upright, TV and fully reclined positions.

As a second aspect, embodiments of the invention are directed to a wall-proximity reclining seating unit comprising: a frame having a back member and a pair of arms, the back member being fixed relative to and extending between the arms; a backrest; a seat; a single footrest having a depth of between about 8 and 12 inches; a reclining mechanism connected between the frame, backrest, seat, and footrest, the reclining mechanism comprising a series of pivotally interconnected links and configured to move the seating unit between: (a) an upright position, in which the backrest is disposed at a first generally upright backrest angle, the seat is disposed at a first generally horizontal seat angle, and the footrest is retracted below a forward portion of the seat and faces generally downwardly and defines an angle of between about 20 and 40 degrees with the underlying surface, (b) a TV position, in which the backrest substantially maintains the first backrest angle, the seat is disposed at a second seat angle that is steeper than the first seat angle, the footrest is extended in front of the seat and is generally horizontally disposed, and the seat and backrest are moved forwardly relative to the frame between about 2.5 and 4 inches; and (c) a fully reclined position, in which the backrest is disposed at a second backrest angle that is shallower than the first backrest angle, the footrest remains extended in front of the seat, and the seat is moved forward of its position in the TV position between about 4 and 7 inches; and a power actuator coupled to the reclining mechanism that drives the backrest, seat and footrest between the upright, TV and fully reclined positions. In the TV and fully reclined positions, the footrest is positioned between about 6.5 and 9.5 inches from a frontmost portion of the seat, and in the upright position, a lowermost portion of the footrest is between about 4.5 and 6.5 inches above the underlying surface.

As a second aspect, embodiments of the invention are directed to a wall-proximity reclining seating unit comprising: a frame having a back member and a pair of arms, the back member being fixed relative to and extending between the arms; a backrest; a seat; a single footrest having a depth of between about 8 and 12 inches; a reclining mechanism connected between the frame, backrest, seat, and footrest, the reclining mechanism comprising a series of pivotally interconnected links and configured to move the seating unit between: (a) an upright position, in which the backrest is disposed at a first generally upright backrest angle, the seat is disposed at a first generally horizontal seat angle, and the footrest is retracted below a forward portion of the seat and faces generally downwardly and defines an angle of between about 20 and 40 degrees with the underlying surface, (b) a TV position, in which the backrest substantially maintains the first backrest angle, the seat is disposed at a second seat angle that is steeper than the first seat angle, the footrest is extended in front of the seat and is generally horizontally disposed, and the seat and backrest are moved forwardly relative to the frame between about 2.5 and 4 inches; and (c) a fully reclined position, in which the backrest is disposed at a second backrest angle that is shallower than the first backrest angle, the footrest remains extended in front of the seat, and the seat is moved forward of its position in the TV position between about 4 and 7 inches; and a power actuator coupled to the reclining mechanism that drives the backrest, seat and footrest between the upright, TV and fully reclined positions.

DETAILED DESCRIPTION

Figure 1:
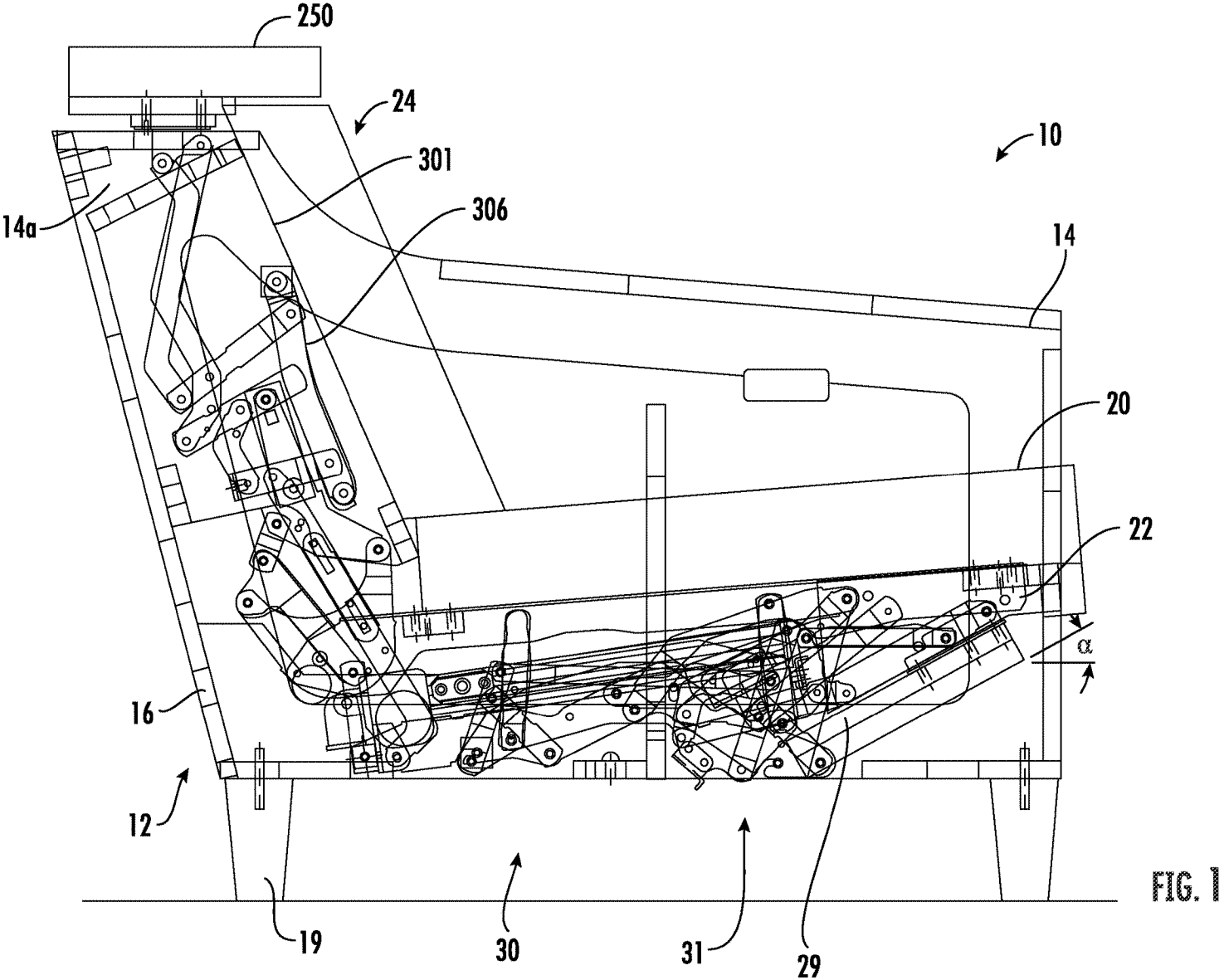
FIG. 1 is a side view of a wall-proximity reclining seating unit according to embodiments of the invention, the seating unit shown in the upright position.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence of addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to the figures, a reclining wall-avoiding seating unit, designated broadly at 10, is shown in FIGS. 1-7. The seating unit 10 includes a frame 12 having two opposed arms 14 connected by multiple cross-members 16. Specifically, the frame 12 includes an upper cross-member 18 that spans upper end portions 14*a* of the arms 14, and is supported by feet 19, which may be at least 4 inches in height. An inner wall 15 is present and substantially centered between the arms 14.

The seating unit 10 is shown as a two-seat "love seat." The concepts described herein are equally applicable to single seat units (i.e., chairs), as well as larger units like sofas, section pieces, and the like. Each seating location includes a seat 20 with a cushion (not labelled) that overlies a seat frame 22, a backrest 24 and a footrest 29.

The seat 20, the backrest 24 and the footrest 29 of each seating location are interconnected by two mirror image reclining mechanisms 30. The reclining mechanisms 30 comprise a series of pivotally interconnected links and are arranged and configured to move the seating unit between (a) an upright position, in which the backrest is disposed at a first generally upright backrest angle, the seat is disposed at a first generally horizontal seat angle, and the footrest is retracted below a forward portion of the seat and faces generally downwardly, (b) a TV position, in which the backrest substantially maintains the first backrest angle, the seat is disposed at a second seat angle that is steeper than the first seat angle, the footrest is extended in front of the seat and is generally horizontally disposed, and the seat and backrest are moved forwardly relative to the frame and (c) a fully reclined position, in which the backrest is disposed at a second backrest angle that is shallower than the first backrest angle, the footrest remains extended in front of the seat, and the seat is moved forward of its position in the TV position.

The mechanisms 30 are mirror images of each other about a longitudinal plane that divides each seating unit into left and right sides. As such, only one reclining mechanism 30 will be discussed in detail herein, with the understanding that the discussion is equally applicable to its mirror image mechanism and to the reclining mechanisms 30 of the other seating location. Also, the reclining mechanism 30 will be described first with respect to the fully reclined position (FIGS. 3 and 6) in order to illustrate more easily the interconnection of the various links thereof.

As used herein to describe the relative positions of components, the terms "lateral" "outward" and derivatives thereof indicate the directions defined by a vector beginning at a vertical plane that bisects the seating unit 10 normal to the seat 20 and the backrest 24 and extending normal thereto. Conversely, the terms "inward", "inboard" and derivatives thereof indicate the direction opposite the "outward" direction. Together, the "inward" and "outward" directions comprise the "transverse" axis of the seating unit 10. The "rear" of the seating unit 10 is directed toward the backrest 24, and the "front" of the seating unit 10 is directed toward the seat 20 and footrest 29. The "front" and "rear" directions comprise the "longitudinal" axis of the seating unit 10.

Figure 3:
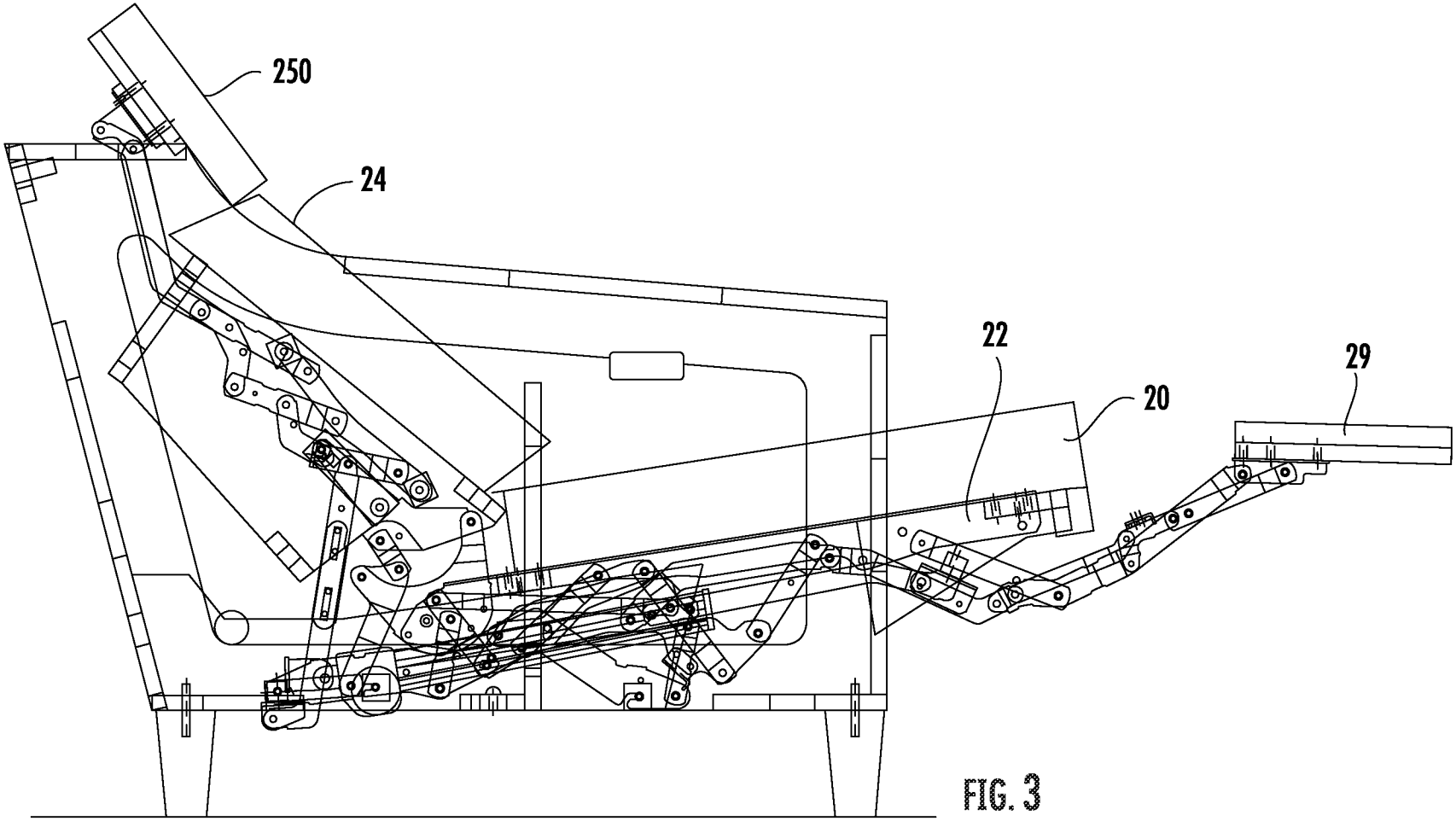
FIG. 3 is a side view of the seating, unit of FIG. 1 shown in the fully reclined position.
Figure 6:
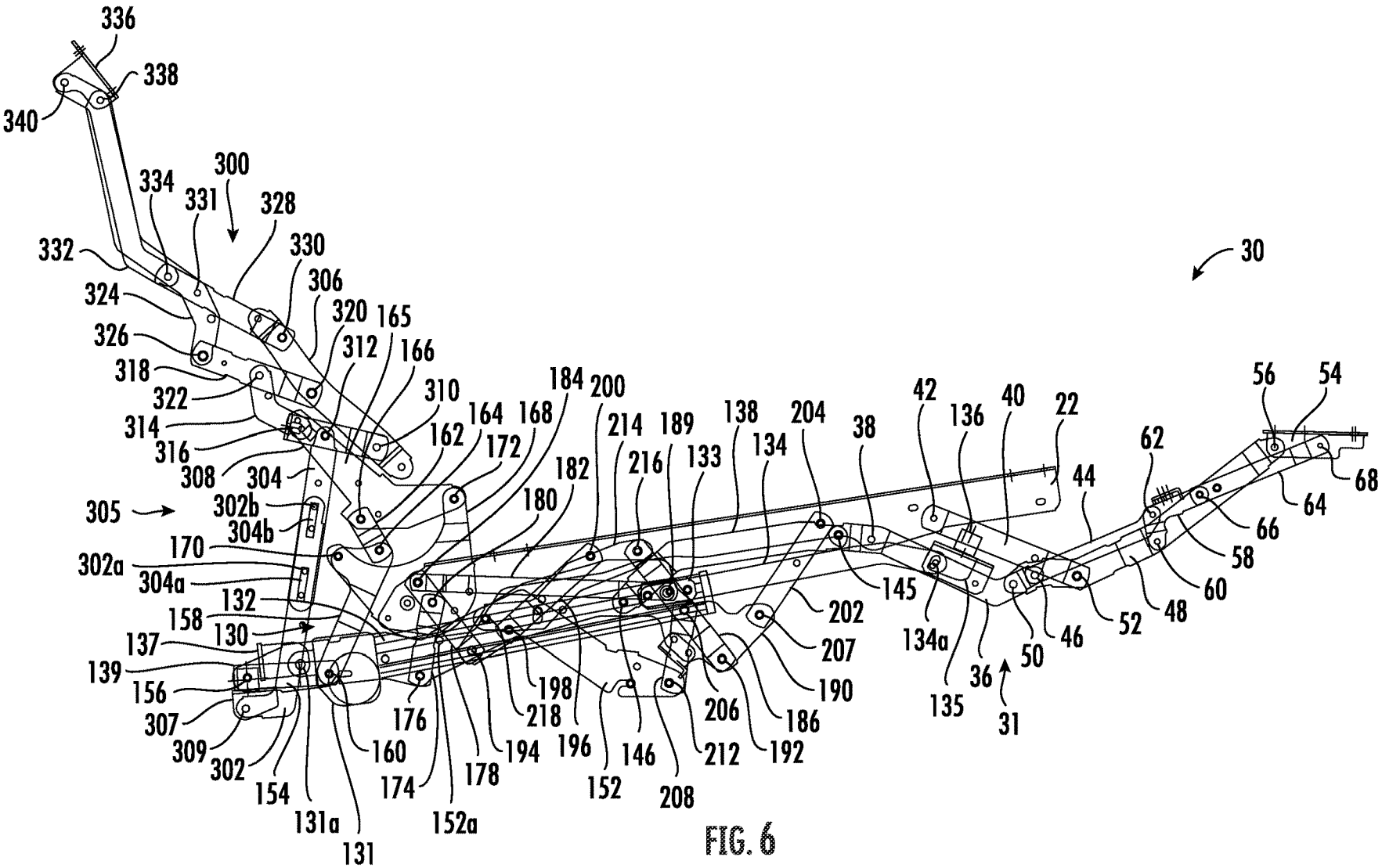
FIG. 6 is a side view of the mechanism of FIG. 4 shown in the fully reclined position.
Figure 7:
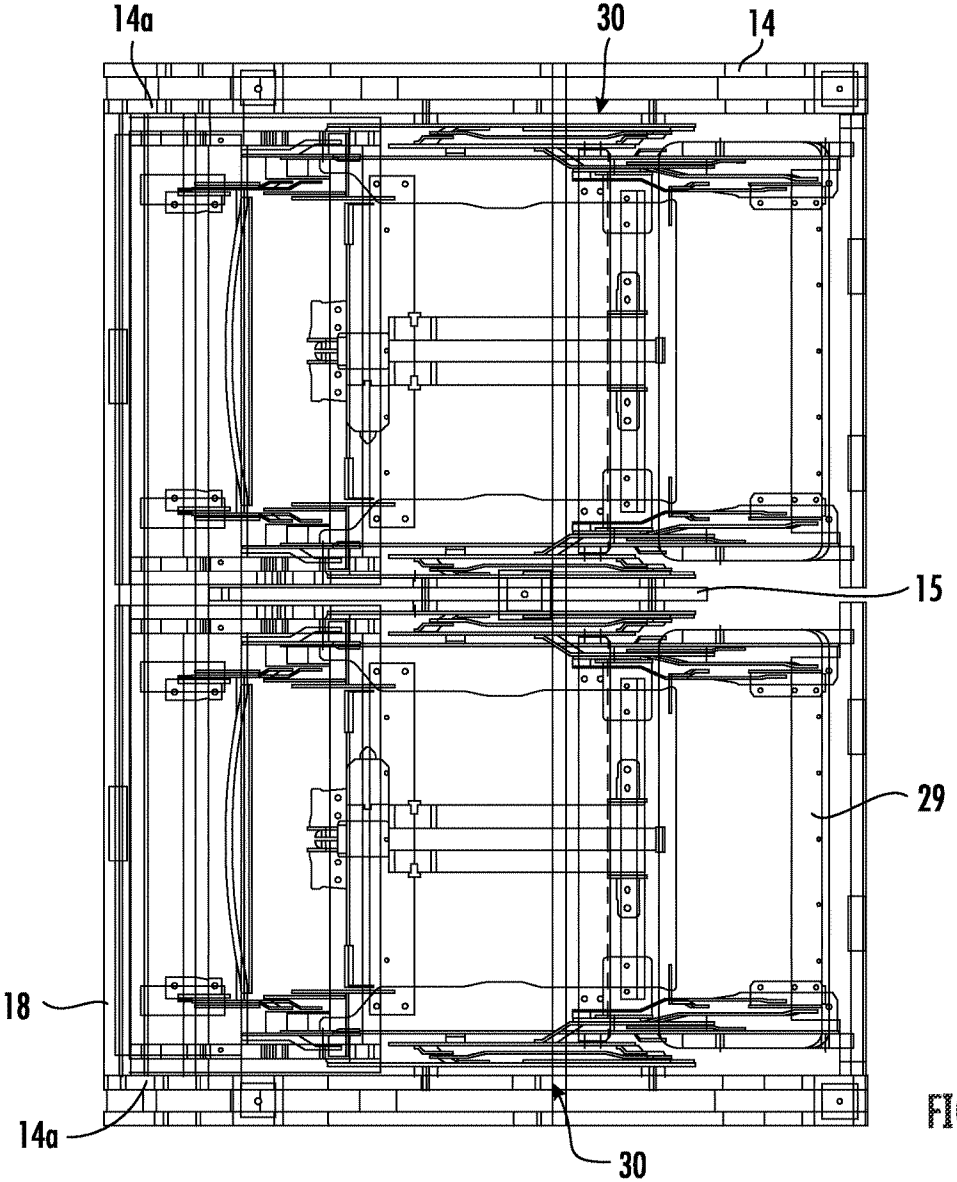
FIG. 7 is a top view of the seating unit of FIG. 1.

Referring now to FIGS. 3 and 6, the reclining mechanism 30 includes a footrest linkage 31 that controls the movement of the footrest 29 relative to the seat 20. The footrest linkage 31 includes an angled lower footrest swing link 36 that is attached to a forward portion of the seat frame 22 at a pivot 38 and extends downwardly and forwardly therefrom. Similarly, an upper footrest swing link 40 is attached near the front end of the seat frame 22 at a pivot 42 and extends forwardly and downwardly therefrom. An upper footrest extension link 44 is attached to the front end of the lower footrest swing link 36 at a pivot 46 and extends forwardly and slightly upwardly therefrom. A lower footrest extension link 48 is attached to the lower footrest swing link 36 at a pivot 50 that is located slightly rearwardly of the pivot 46 and extends generally parallel with, but slightly below, the upper footrest extension link 40. The lower footrest extension link 48 is also attached to the lower end of the upper footrest swing link 40 at a pivot 52.

The lower footrest extension link 48 is attached at a pivot 56 to a footrest mounting bracket 54 on which the footrest 29 is mounted. An angled crank 58 is attached at its lower end to the lower footrest extension link 48 at a pivot 60, and at its vertex to the forward end of the upper footrest extension link 44 at a pivot 62. The forward end of the crank 58 is attached to a bracing link 64 at a pivot 66; the bracing link 64 also attaches to the footrest mounting bracket 54 at a pivot 68 that is forward of the pivot 56. It can be seen in FIG. 3 that the footrest 29 extends considerably in front of the footrest mounting bracket 54; typically this distance is between about 4 and 7 inches. In some embodiments, the footrest 29 itself is between about 8 and 12 inches in depth (often about 9.5 and 10.5 inches), such that in the extended portion the forward end of the footrest 24 is between about 15 and 20 inches in front of the front edge of the seat 20, and the rear end of the footrest 29 is between about 6.5 and 9.5 inches. It is also typical that a footrest 29 of this size is a single footrest, such that the seating unit 10 is devoid of additional footrests.

Referring still to FIGS. 3 and 6, the reclining mechanism 30 includes a foundation link 152 that is fixed to the inner surface of the arm 14*a* or to the inner wall 15 to provide mounting locations for multiple links of the reclining mechanism 30. A lower rear swing link 154 is mounted to the foundation link 152 at a pivot 156 and extends forwardly and slightly upwardly therefrom. An angled upper rear swing link 158 is attached at its lower end to the lower rear swing link 154 at a pivot 160 and extends upwardly and slightly forwardly therefrom. A control link 162 is attached at its lower end to the vertex of the upper rear swing link 158 at a pivot 164 and extends upwardly and slightly rearwardly to a pivot 166 with a backpost 165 fixed to the backrest 24. A saddle-shaped extension 168 is fixed to the rear end of the seat frame 22; the extension 168 is attached to the backpost 165 at a pivot 172 and to the upper end of the upper rear swing link 158 at a pivot 170.

A rear recline link 174 is attached to the foundation link 152 at a pivot 176 and extends upwardly and slightly forwardly therefrom. A transition link 178 is attached in an intermediate location to the upper end of the rear recline link 174 at a pivot 180. The lower end of the transition link 178 is attached to a carrier link 190 at a pivot 194. The upper end of the transition link 178 is attached at a pivot 184 to the rear end of a coupling link 182.

A front recline link 208 is attached at its lower end to the forward end of the foundation link 152 at a pivot 212. At its upper end, the front recline link 208 is attached to an intermediate location of a drawing link 186 at a pivot 206. The drawing link 186 is attached at its lower end to the carrier link 190 at a pivot 192. The forward end of the coupling link 182 is attached to a central position on the drawing link 186 at a pivot 189. At its upper end, the drawing link 186 is attached to a drive link 214 at a pivot 216. The drive link 214 is attached at its rear end to the foundation link 152 at a pivot 218. A rear seat swing link 196 is attached to the rear end of the carrier link 190 at a pivot 198 and to the seat frame 22 at a pivot 200. A forward seat swing link 202 is attached to the carrier link 190 at a pivot 207 and to the seat frame 22 at a pivot 204. A footrest drawing link 138 is attached to the rear end of the lower footrest swing link 36 at a pivot 145 and to the carrier link 190 at a pivot 146.

A linear actuator 130 is employed to drive the seating unit 10 between positions. The linear actuator 130 includes a motor 131, a rail 132, and a carriage 133 that is configured to move along the rail 132 (driven by the motor 131). An actuator drive link 134 is mounted to the carriage 133 and is attached via a pivot 134*a* to a bracket 135 that is fixed to a cross-member 136 that is fixed to and spans the lower footrest swing links 36. The motor 131 is attached to a bracket 137 at a pivot 131*a*. The bracket 137 is fixed to a cross-member 139 that spans the lower rear swing links 154.

The seating unit 10 also includes an extendable headrest 250 that is coupled with the reclining mechanism 30. The headrest 250 moves between a retracted position, in which the headrest 250 is generally horizontal and rests atop the backrest 24, and an extended position, in which the headrest 250 is generally upright and above and generally parallel with the backrest 24. The headrest 250 is in the retracted position when the seating unit 10 is in the upright position (FIGS. 1 and 4), and in the extended position when the seating unit 10 is in the TV (FIGS. 2 and 5) and fully reclined positions (FIGS. 3 and 6). The movement of the headrest 250 is controlled by the headrest mechanism 300, which comprises two mirror image linkages, one of which is described in detail below.

Figure 2:
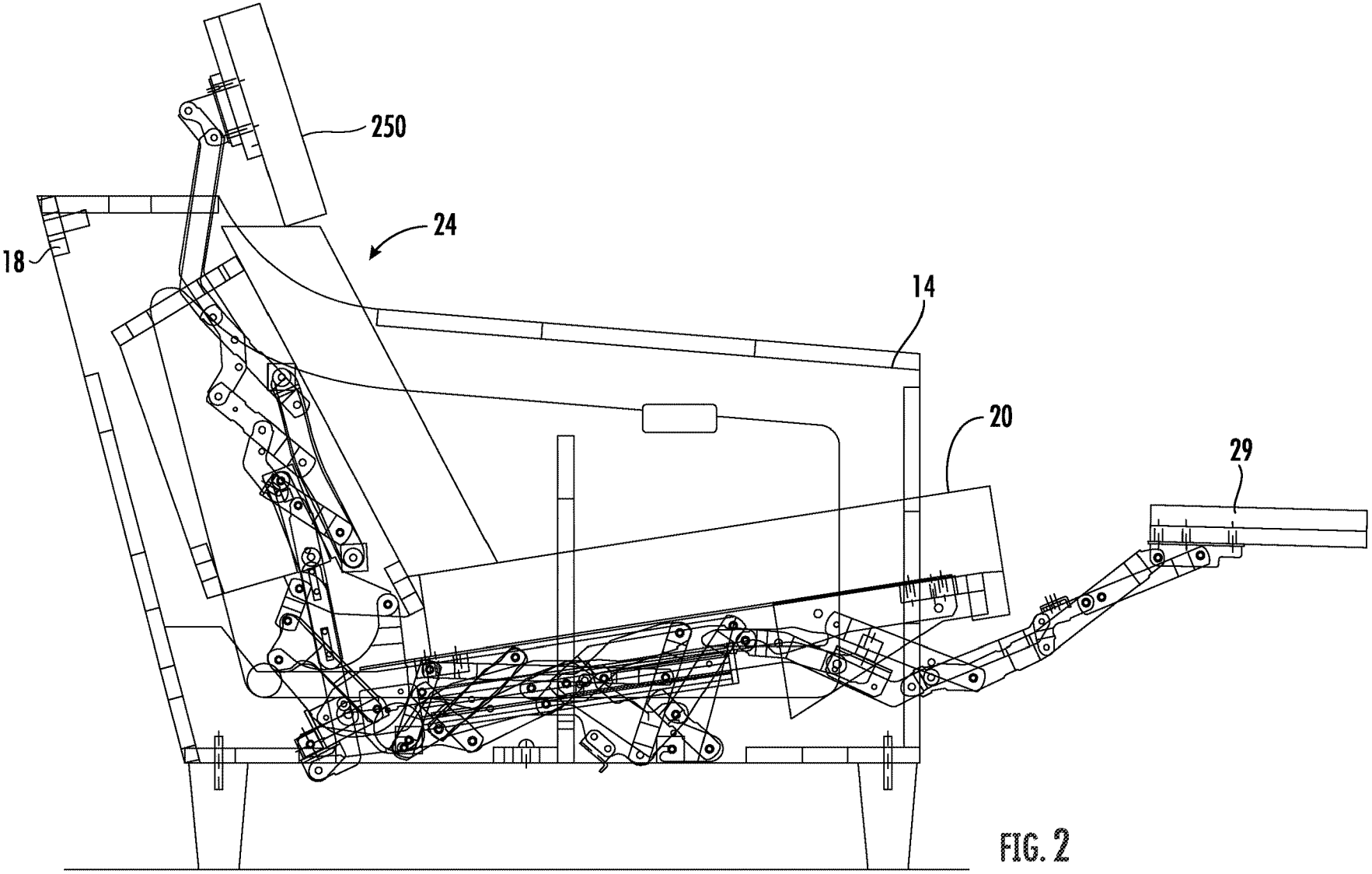
FIG. 2 is a side view of the seating, unit of FIG. 1 shown in the TV position.

As can be seen in FIGS. 1-3, a foundation panel 301 is mounted to the rear surface of the backrest 24 and extends rearwardly therefrom. The backpost 165 is fixedly mounted near the forward edges of the foundation panels 301. A mounting link 306 is also fixed to the forward portion of each of the foundation panels 301.

Figure 4:
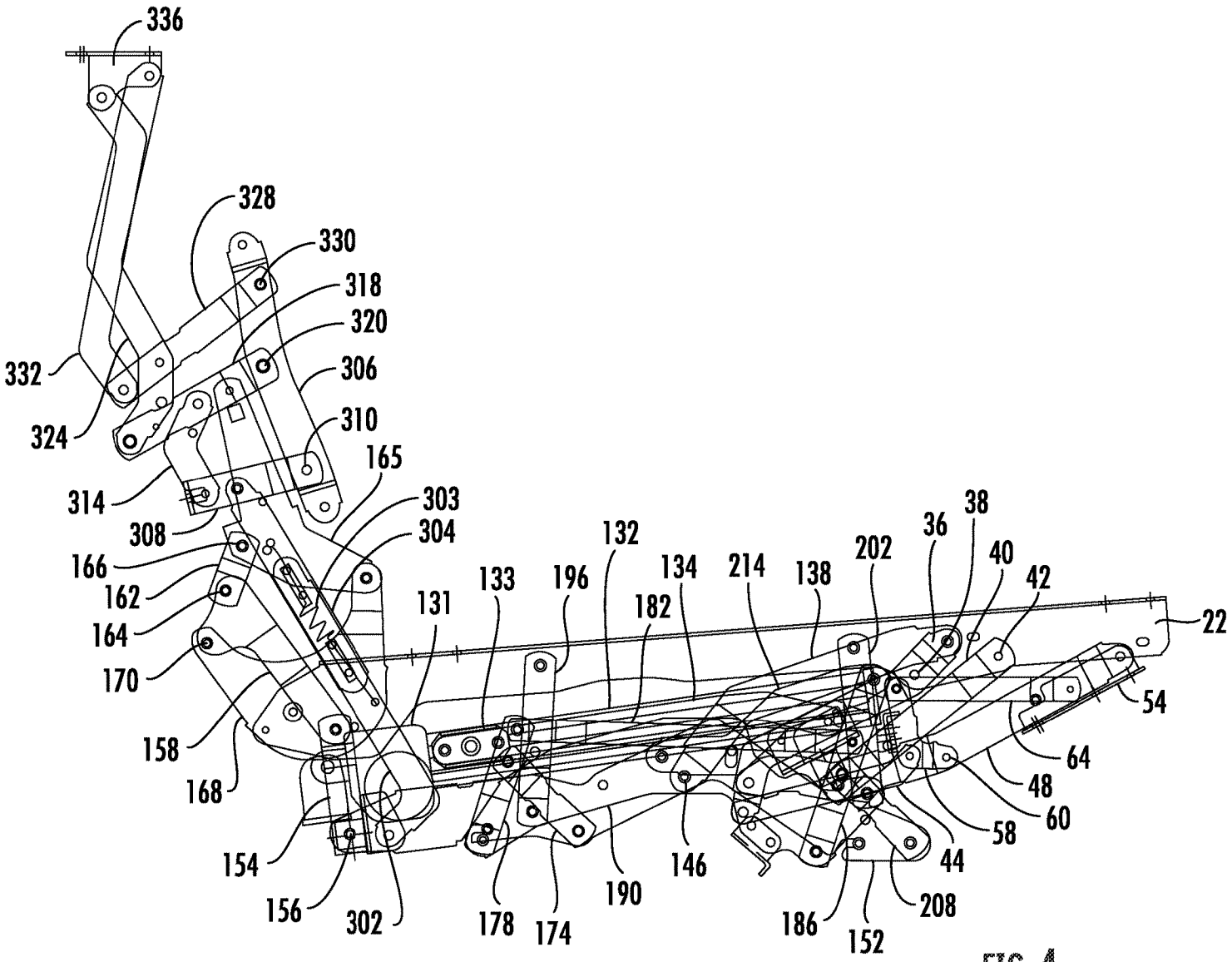
FIG. 4 is a side view of the reclining and footrest mechanism of the seating unit of FIG. 1 shown in the upright position.
Figure 5:
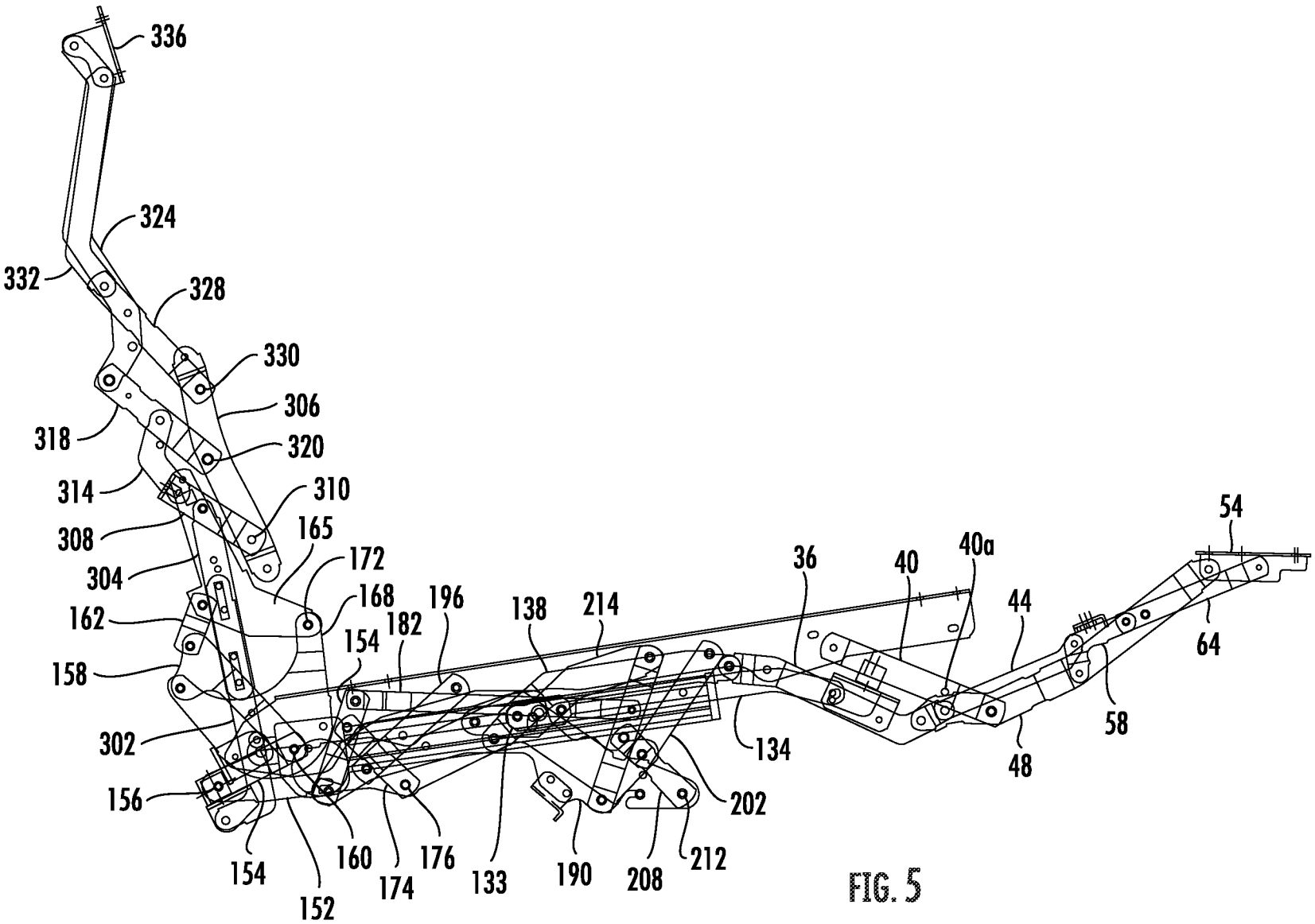
FIG. 5 is a side view of the mechanism of FIG. 4 shown in the TV position.

Referring now to FIGS. 4-6, lower, middle and upper swing links 308, 318, 328 are pivotally attached to the mounting link 306 at pivots 310, 320, 330, respectively, and extend rearwardly therefrom. A short connecting link 314 extends between the lower and middle swing links 308, 318 and is attached at pivots 316, 322. A forward extension link 324 is attached to the middle and upper swing links 318, 328 at pivots 326, 331 and extends upwardly from the pivot 331 to attach to a headrest bracket 336 at a pivot 338. A rear extension link 332 extends from a pivot 334 with the upper swing link 328 to a pivot 340 with the headrest bracket 336.

A drive link assembly 305 includes lower and ripper segments 302, 304. The lower segment 302, 304 includes two pins 302*a*, 302*b* that are received in respective slots 304*a*, 304*b* in the upper segment 304. The pins 302*a*, 302*b* and slots 304*a*, 304*b* enable the segments 302, 304 to slide relative to each other. A spring 303 (shown schematically in FIG. 4) extends between the segments 302, 304 and biases them toward each other (i.e., to a shortened overall length for the drive link assembly 305). The lower segment 302 is attached at a pivot 309 to a bracket 307 that is fixed to the cross-member 138 to which the linear actuator 130 is mounted via the bracket 137. The upper segment 304 is mounted at a pivot 312 to the lower swing link 308.

Operation of the seating unit 10 typically commences with the seating unit 10 in the upright position of FIGS. 1 and 4. In the upright position, the footrest linkage 31 is folded under the front portion of the seat 20, with the footrest 29 retracted below a forward portion of the seat 20 and facing generally downwardly (the footrest 29 forms an angle $\alpha$ of between about 20 and 40 degrees with the underlying surface on which the seating unit 10 rests, with the surface opposite the footrest mounting bracket 54 facing downwardly). Thus, the footrest 29 is "tucked under" the seat 20 and is hidden from view (in some embodiments, the lowermost portion of the footrest 29 is between about 4.5 and 6.5 inches above the underlying surface). The rear seat swing link 196 and the forward seat swing link 202 are both disposed generally upright. The rear recline link 174 and the front recline link 208 are also disposed generally upright, but with a rearward lean. Both the transition link 178 and the drawing link 186 are tilted generally forwardly. The carrier link 190 is generally horizontal and generally centered longitudinally relative to the foundation bracket 152. The seat frame 22 has a slight pitch (between about 2 and 7 degrees). The backrest 24 is tilted slightly rearwardly (at an angle of between about 105 and 120 degrees relative to horizontal), with the upper portion of the backrest 24 adjacent the upper cross-member 18.

Also, as shown in FIGS. 1 and 4, in the upright position, the headrest 250 is substantially horizontal and rests on upper edge of the backrest 24. The drive link assembly 305 is in a Shortened condition, with the pins 302*a*, 302*b* in the upper ends of the slots 304*a*, 304*b*. The lower, middle and upper swing links 308, 318, 328 all extend downwardly and rearwardly from the foundation panel 301. The pivots 338, 340 are essentially level, which causes the headrest bracket 336 (and in turn the headrest 250) to be disposed horizontally. Pins on the connecting link 314 and the front extension link 324 contact edges of the middle and upper swing links 318 to maintain the mechanism 300 in this position.

The seating unit 10 is maintained in the upright position by the actuating mechanism 130. The carriage 133 is maintained in a rearward position on the rail 132, which draws the actuator drink link 134 to a rearward position.

To move the seating unit 10 to the TV position of FIGS. 2 and 5, the occupant of the seating unit 10 activates the actuating unit 130. Often the actuating unit 130 may be activated via one or more buttons, switches, toggles, or the like that are attached to the seating unit 10 and within easy reach of the occupant (for example, buttons may be mounted on the inside or outside of one of the arms 14, or mounted as part of a console or handheld remote control device). Such buttons, switches, etc., are operatively connected with the motor 131 (e.g., they may be hard-wired or wireless) to cause the motor 131 to operate. Typically, each of the seating locations will have a separate set of controls so that the seats 20, footrest 29 and backrests 24 of each seating location operate independently.

Operation of the motor 131 drives the carriage 133 (and the actuator drive link 134) forwardly on the rail 132. Forward movement of the actuator drive link 134 pushes the cross-member 136 forwardly, which in turn causes the lower footrest swing link 36 to pivot counterclockwise (from the vantage point of FIGS. 1 and 2) about the pivot 38. Such rotation forces the lower footrest extension link 48 forwardly and slightly upwardly, which rotates the upper footrest swing link 40 counterclockwise about the pivot 42. Rotation of the lower footrest swing link 36 also drives the upper footrest extension link 44 forwardly and slightly upwardly. In moving forwardly, the lower footrest extension link 48 descends slightly relative to the upper footrest extension link 44, with the result that the crank 58 rotates clockwise about the pivot 60. Rotation of the crank 58 forces the bracing link 64 forwardly relative to the lower footrest extension link 48. This relative movement causes the footrest 29 to invert itself (i.e., it rotates between about 140 to 160 degrees counterclockwise) to a position well in front of the seat 20 in which it is generally horizontally disposed. Movement ceases when the upper edge of the lower footrest extension link 48 contacts a stop pin 40*a* on the upper footrest swing link 40.

In addition, rotation of the lower footrest swing link 36 creates a rearwardly-directed force on the footrest drawing link 138, Which is also directed to the carrier link 190 at the pivot 146. However, the carrier link 190 is prevented from rearward movement by the presence of an "over-center" arrangement of the pivots 170, 164, 166 (see FIG. 4); thus, an oppositely-directed forward reaction force is imposed on the seat frame 22. As a result, the seat frame 22 (and the remainder of the seat 20) move forwardly relative to the carrier link 190 (and, in turn, relative to the base 12 along with the foundation link 152 mounted thereto). The forward movement of the seat frame 22 is controlled by the rear and front seat swing links 196, 202. The forward movement of the seat frame 22 also rotates the lower rear swing link 154 clockwise about the pivot 156. The rear end of the seat frame 22 descends, thereby increasing the pitch angle of the seat 20 by 2 to 10 degrees.

Notably, the length and upright to slightly rearward disposition of the rear and front intermediate swing links 196, 202 enables the seat 20 to move forwardly a greater distance than many previous seating units. In some embodiments, the forward movement of the seat 20 relative to the base 12 is between about 2.5 and 4 inches, which occurs with substantially no relative movement between the carrier link 190 and the base 12.

Also, as the rear end portion of the seat frame 22 moves forwardly and downwardly, this movement draws the backrest 24 and the foundation panels 301 forwardly and downwardly. The drive link assembly 305 remains generally at the same elevation, but rotates slightly clockwise about the pivot 309. The downward movement of the mounting bracket 306 relative to the drive link assembly 305 causes the lower swing link 308 to pivot clockwise about the pivot 310. Rotation of the lower swing link 308 drives the connection link 314 upwardly, which forces the middle swing link 318 to pivot clockwise about the pivot 320. This action drives the front elevation link 324 upwardly, which in turn rotates the upper swing link 328 clockwise about the pivot 330. Rotation of the upper swing link 328 drives the rear extension link 332 upwardly. As the front and rear extension links 324, 332 rise, they cause the headrest bracket 336 and the attached headrest 250 to take a generally upright disposition (FIGS. 2 and 5), in which the front surface of the headrest 250 is generally parallel with the front of the backrest 24. Typically, the angle of the headrest 250 and the backrest 24 is between about 65 and 80 degrees relative to horizontal (i.e., to the floor).

To move the seating unit 10 from the TV position of FIGS. 2 and 5 to the fully reclined position of FIGS. 3 and 6, the occupant of the seating unit activate the linear actuator 130, which causes the carriage 133 to continue to move forwardly relative to the rail 132. This motion forces the actuator drive link 134 forward and provides a forwardly-directed force on the lower footrest swing link 36. However, because the footrest linkage 31 is fully extended, and the seat frame 22 and carrier link 190 are unable to move relative to each other, forward movement of the actuator drive link 134 drives the carrier link 190 (along with the seat frame 22) forwardly relative to the foundation link 152. This movement is controlled by the rear recline link 174 and the front recline link 208, which pivot clockwise relative to the foundation link 152 about pivots 176, 212. The rotation of these recline links 174, 208 forces the carrier link 190 forward via the transition link 178 and the drawing link 186, which are attached to the carrier link 190. Forward movement of the carrier link 190 in turn moves the seat frame 22 forward. This movement continues until the rear recline link 174 contacts a pin 152*a* on the foundation link 152.

In addition, the forward movement of the seat frame 22 relative to the foundation link 152 draws the backpost 165 (and backrest 24) counterclockwise about the pivot 172. This rotation first causes the lower rear swing link 154 to fully extend forwardly, at which point the upper rear swing link 158 rotates clockwise about the pivot 160. This movement raises the rear end of the seat frame 22 and forces it forwardly, and also causes the backrest 24 to move to a reclined position (i.e., a position with an increased angle relative to the seat 20).

In moving from the TV position to the fully reclined position, the seat frame 22 moves forwardly relative to the base 12 between about 4 and 7 inches, which occurs with substantially no relative forward movement between the seat frame 22 and the earlier link 190. When this distance is combined with the forward movement of the seat frame 22 relative to the base 12 in moving from the upright position to the TV position, the total distance may be as much as 6.5 to 11 inches. Importantly, as can be seen in FIG. 3, this degree of movement can enable the backrest 24 to reach the fully reclined position even with the presence of the rear cross-member 18 (i.e., the uppermost end of the backrest 24 is positioned forwardly of the rear cross-member 18). As such, a seating unit according to embodiments shown herein can have wall-proximity capability even with a seating unit that has a hilly formed back, which is often the case with seating units that are fully upholstered in the rear.

Also, as the linear actuator 130 continues to extend and moves the seating unit 10 from the TV position of FIGS. 2 and 5 to the fully reclined position (FIGS. 3 and 6), the relationship between the headrest 250 and the backrest 24 remains largely the same. Thus, as the backrest 24 reclines to a shallower angle in the manner described above, so does the headrest 250 (the angle of the backrest 24 and the headrest 250 relative to horizontal is typically between about 45 and 65 degrees).

It should be noted that, when the headrest 250 is in the retracted position and resting atop the backrest 24, the drive link assembly 305 has the ability to extend, i.e., the upper segment 304 can slide upwardly relative to the lower segment 302. This capability can provide a convenience feature to the seating unit 10, as the headrest 250 can pivot upwardly from the backrest 24 (resisted somewhat by the spring 303, as it biases the segments 302, 304 toward remaining retracted). Thus, if a person, animal or object were resting on the upper surface of the rear portion of the frame as the seating unit 10 moves to the upright position, it would not be trapped against the frame by the headrest 250 as it folds into its retracted position, as the allowable movement between the segments 302, 304 enables the headrest 250 to pivot away from the frame.

It should also be noted that the illustrated seating unit 10 is an "off-the-ground" high-leg style, such that there is space between the lower edges of the arms 14 and the underlying floor (this distance may be between about 4 and 7 inches). It can be seen that the seating unit 10 has wall-proximity capability while still having a reclining mechanism 30 that folds into a sufficiently small "package" that the reclining mechanism 30 is not visible from the side of the seating unit 10 when the seating unit 10 is in the upright position, and can do so with the seating unit 10 maintaining a typical height of the seat 20 above the underlying surface (e.g., 18-23 inches).

In addition, this configuration also enables the use of a deeper seat frame 22, Which can provide more room front-to-back for sitting, laying down, napping, etc. Further, in some embodiments, a unitary upholstery piece (e.g., a cushion or pad) can be used to cover the seat and the footrest 29. As an example, the pad can be attached to the rear end of the seat 20, extend forwardly to cover the seat 20, extend downwardly to cover the front surface of the footrest 29, and attach to the rear side of the footrest 29. Extension/retraction of the footrest 29 and forward movement of the seat 20 are such that the pad can remain taut, but not overstretch, as these components move between positions. Such a pad is shown and described in U.S. Patent Publication No. 2020/0163458 to Murphy, the disclosure of which is hereby incorporated herein by reference.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

That which is claimed is:

1. A wall-proximity reclining seating unit, comprising:

a frame having a back member and a pair of arms, the back member being fixed relative to and extending between the arms;

a backrest;

a seat;

a footrest;

a reclining mechanism connected between the frame, backrest, seat, and footrest, the reclining mechanism comprising a series of pivotally interconnected links and configured to move the seating unit between: (a) an upright position, in which the backrest is disposed at a first generally upright backrest angle, the seat is disposed at a first generally horizontal seat angle, and the footrest is retracted below a forward portion of the seat and faces generally downwardly and defines an angle of between about 20 and 40 degrees with the underlying surface, (b) a TV position, in which the backrest substantially maintains the first backrest angle, the seat is disposed at a second seat angle that is steeper than the first seat angle, the footrest is extended in front of the seat and is generally horizontally disposed, and the seat and backrest are moved forwardly relative to the frame between about 2.5 and 4 inches; and (c) a fully reclined position, in which the backrest is disposed at a second backrest angle that is shallower than the first backrest angle, the footrest remains extended in front of the seat, and the seat is moved forward of its position in the TV position between about 4 and 7 inches; and a power actuator coupled to the reclining mechanism that drives the backrest, seat and footrest between the upright, TV and fully reclined positions.

2. The reclining seating unit defined in claim 1, wherein the back member is attached adjacent an upper end of the frame.

3. The reclining seating unit defined in claim 2, wherein in the fully reclined position, an upper end of the backrest is forward of the back member.

4. The reclining seating unit defined in claim 1, Wherein the reclining mechanism includes a foundation link fixed to the frame and a carrier link pivotally attached with the foundation link, and wherein the seat includes a seat frame, and wherein (a) when the seating unit moves from the upright position to the TV position, the seat frame moves forwardly relative to the carrier link, and the carrier link is substantially stationary relative to the foundation link, and (b) when the seating unit moves from the TV position to the fully reclined position, the carrier link moves forwardly relative to the foundation link, and the seat frame does not move substantially forwardly relative to the carrier link.

5. The reclining seating unit defined in claim 4, wherein the seat frame includes an extension fixed to a rear portion thereof, and the backrest includes a backpost that is directly attached to the extension via a single pivot axis.

6. The reclining seating unit defined in claim 5, wherein the reclining mechanism further comprises a rear intermediate swing link and a front intermediate swing link, each of the rear intermediate swing link and the front intermediate swing, link being directly pivotally interconnected between the carrier link and the seat frame.

7. The reclining seating unit defined in claim 6, wherein in the upright position, each of the rear intermediate swing link and the front intermediate swing link is inclined slightly rearwardly as it extends from the carrier link to the seat frame.

8. The reclining seating unit defined in claim 6, wherein the reclining mechanism includes a lower rear swing link pivotally attached to the foundation link, an upper rear swing link pivotally attached to the lower rear swing link and to the extension, and a control link pivotally attached to the upper rear swing link and to the backpost.

9. The reclining seating unit defined in claim 8, wherein in the control link is inclined forwardly as it extends upwardly from the upper rear swing link to the backpost in each of the upright, TV and fully reclined positions.

10. The reclining seating unit defined in claim 1, wherein the footrest is a single footrest, such that the reclining seating unit is void of another footrest.

11. The seating unit defined in claim 1, wherein the footrest is between about 8 and 12 inches in depth.

12. The seating unit defined in claim 1, wherein in TV and fully reclined positions, the footrest is positioned between about 6.5 and 9.5 inches from a frontmost portion of the seat.

13. The seating unit defined in claim 1, wherein in the upright position, a lowermost portion of the footrest is between about 4.5 and 6.5 inches above the underlying surface.

14. A wall-proximity reclining seating unit, comprising:

a frame having a back member and a pair of arms, the back member being fixed relative to and extending between the arms;

a backrest;

a seat;

a single footrest having a depth of between about 8 and 12 inches;

a reclining mechanism connected between the frame, backrest, seat, and footrest, the reclining mechanism comprising a series of pivotally interconnected links and configured to move the seating unit between: (a) an upright position, in which the backrest is disposed at a first generally upright backrest angle, the seat is disposed at a first generally horizontal seat angle, and the footrest is retracted below a forward portion of the seat and faces generally downwardly and defines an angle of between about 20 and 40 degrees with the underlying surface, (b) a TV position, in which the backrest substantially maintains the first backrest angle, the seat is disposed at a second seat angle that is steeper than the first seat angle, the footrest is extended in front of the seat and is generally horizontally disposed, and the seat and backrest are moved forwardly relative to the frame between about 2.5 and 4 inches; and (c) a fully reclined position, in which the backrest is disposed at a second backrest angle that is shallower than the first backrest angle, the footrest remains extended in front of the seat, and the seat is moved forward of its position in the TV position between about 4 and 7 inches; and a power actuator coupled to the reclining mechanism that drives the backrest, seat and footrest between the upright, TV and fully reclined positions;

wherein in TV and fully reclined positions, the footrest is positioned between about 6.5 and 9.5 inches from a frontmost portion of the seat; and wherein in the upright position, a lowermost portion of the footrest is between about 4.5 and 6.5 inches above the underlying surface.

* * * * *